US005085411A

United States Patent [19]

Tanaka et al.

[11] Patent Number: 5,085,411

[45] Date of Patent: Feb. 4, 1992

[54] APPARATUS FOR PROCESSING GRAIN-ORIENTED ELECTRICAL STEEL STRIP

[75] Inventors: Yoshinao Tanaka, Tokyo; Takaaki Ohsawa; Akira Tanabe, both of Himeji, all of Japan

[73] Assignee: Nippon Steel Corporation, Tokyo, Japan

[21] Appl. No.: 621,762

[22] Filed: Dec. 4, 1990

[30] Foreign Application Priority Data

Dec. 7, 1989 [JP] Japan ..... 1-316453

[51] Int. Cl.[5] ..... B21B 39/02

[52] U.S. Cl. ..... 266/102; 72/197; 148/110

[58] Field of Search ..... 266/102; 72/197; 148/110, 111

[56] References Cited

U.S. PATENT DOCUMENTS

| | | | |
|---|---|---|---|
| 4,468,551 | 8/1984 | Neiheisel | 219/121 |
| 4,533,409 | 8/1985 | Benford | 148/111 |
| 4,711,113 | 12/1987 | Benford | 72/197 |
| 4,728,083 | 3/1988 | Ruediger | 266/274 |
| 4,742,706 | 5/1985 | Sasaki et al. | 72/197 |
| 4,770,720 | 9/1988 | Kobayashi et al. | 148/111 |

FOREIGN PATENT DOCUMENTS

| | | | |
|---|---|---|---|
| 57-2252 | 1/1982 | Japan . | |
| 58-36051 | 8/1983 | Japan . | |
| 58-50298 | 11/1983 | Japan . | |
| 61-15314 | 1/1986 | Japan . | |
| 209740 | 9/1986 | Japan | 72/197 |
| 63-153222 | 6/1988 | Japan . | |

*Primary Examiner*—R. Dean
*Assistant Examiner*—George Wyszomierski
*Attorney, Agent, or Firm*—Kenyon & Kenyon

[57] ABSTRACT

An apparatus for processing grain-oriented electrical steel strip has a groove-scribing unit, which comprises a groove-scribing roll mounted above a pressing roll, disposed on the entry side of an insulation coating unit. A bridle roll is provided above the groove-scribing roll so that the strip may be passed to the groove-scribing and insulating coating units via the bridle roll. The apparatus also has a device for guiding the travel of the bridle roll from above the groove-scribing roll to below the horizontal pass line of the strip and vice versa. A moving device attached to the bridle roll permits the bridle roll to travel up and down along the guiding device together with the strip passed therearound. When the bridle roll is positioned above the groove-scribing roll, the groove-scribing and support rolls are kept close to each other, thereby scribing grooves in the surface of the strip held between the two rolls before the strip is passed to the insulation coating unit. When the bridle roll is positioned below the pass line of the strip, on the other hand, the groove-scribing and pressing rolls are kept away from each other to allow the strip to pass direct to the insulation coating line without touching either roll. Thus, the apparatus provides a choice between two passes for the strip.

9 Claims, 3 Drawing Sheets

APPARATUS FOR PROCESSING GRAIN-ORIENTED ELECTRICAL STEEL STRIP

BACKGROUND OF THE INVENTION

1. Field of the Invention

This invention relates to apparatus for processing grain-oriented electrical steel strip which comprises a core plating line of a conventional type, in which a thin layer of insulation coating is formed on the surface of the strips, and a core-loss improving device that are disposed so that either or both of a common core plating process and a core-loss improving process can be selectively applied to the strip as desired.

2. Description of the Prior Art

As is widely known, grain-oriented electrical steel strip covered with a glass film formed by final (texture) annealing is commonly finished in a coating and flattening line where an insulation coating is applied and baked. Spurred by the recent trends to seek as much energy saving as possible, needs for core loss improvement have increased steadily and several technologies to fulfill such needs have been completed and patented. One of them reduces domain size by use of laser beams. These types of technologies have achieved remarkable core loss improvements with grain-oriented electrical steel strip for stacked cores to which stress-relief annealing is not applied. Inventions on them are disclosed, for example, in the U.S. Pat. No. 4,468,551, Japanese Patent Publications Nos. 2252 of 1982, 36051 of 1983, 50298 of 1983, and so on.

On the other hand, the U.S. Pat. No. 4,770,720 discloses a domain size reducing technology that has proved remarkably effective for grain-oriented electrical steel strip for wound cores that is stress-relief annealed. This method comprises scribing grooves in the surface of the electrical steel strip, with a force of 90 to 220 kgf/mm$^2$, set at an angle of 45 to 90 degrees with the rolling direction and then applying a heat treatment at a temperature of 750° C. or above. The grooves can be scribed by use of toothed-wheel-like rolls whose teeth extend in the direction of, or parallel with, the roll axis, as disclosed in the Japanese Provisional Patent Publication No. 15314 of 1986, the U.S. Pat. No. 4,533,409, and so on.

Because of the severe vibrations set up in scribing, however, the grooves formed by this type of toothed-wheel-like rolls tend to become irregularly spaced over the breadth of the strip, thereby inducing considerable core loss variations. Scribing rolls with helically or diagonally cut teeth of the type disclosed in the Japanese Provisional Patent Publication No. 15314 of 1986 can offer solution for the above problem.

And yet, another problem comes up with helically toothed rolls. When the electrical steel strip is passed, with a given draft, between a helically toothed roll and a pressing roll thereunder, a force set up between the helically toothed roll and the strip works at right angles with the direction of strip travel (or in the direction of the roll axis). The force tends to cause the strip to move breadthwise, thereby hampering the smooth travel of the strip.

The inventor has already proposed a technology to overcome this difficulty in an invention disclosed in the Japanese Provisional Patent Publication No. 153222 of 1988. As is described in the publication, the proposed method provides a roll (hereinafter called the bridle roll) above a toothed roll. The strip fed through a horizontal pass line travels forward to a groove-scribing unit via the bridle roll, with the access angle of the strip reaching the bridle roll adjusted by a preceding roll.

The core-loss improving groove scribing unit and the heat treatment line for the grain-oriented electrical steel strip for wound cores may be installed separately. The insulation coating on the ordinary grain-oriented electrical steel strip is baked at a temperature of 750° C. or above in the coating and flattening line. On the other hand, an insulation coating must be formed on the grain-oriented electrical steel strip covered with a glass film formed by final annealing and scribed with core-loss improving grooves. As such, installing a groove-scribing unit of the type disclosed in the Japanese Provisional Patent Publication No. 153222 of 1988 on the entry side of an insulation coating unit of the type incorporated in the conventional coating and flattening lines for grain-oriented electrical steel strip offers considerable operational advantage by permitting sharing of the insulation coating unit and its auxiliary facilities.

When only an ordinary insulation coating is needed, the grain-oriented electrical steel strip covered with a glass film insulation is passed direct to, i.e., not by way of the bridle roll, the insulation coating unit along the horizontal pass through the open groove-scribing unit. When a core-loss improving treatment is needed, the strip is passed first over the bridle roll to assure a stable travel, and then to the groove-scribing unit, where grooves extending in the longitudinal direction are scribed in the surface of the strip, and to the insulation coating unit to form an insulation coating in the course of a heat treatment that is applied at a temperature of 750° C. or above.

If the bridle roll is fixed as in the preferred embodiment disclosed in the Japanese Provisional Patent Publication No. 153222 of 1988, however, the following steps must be taken for switching the pass line from a horizontal one to a detour pass line via the bridle roll in the course of the continuous strip travel to switch from the ordinary insulation coating process to the core-loss improving process and vice versa.

When switching to the core-loss improving process is anticipated, the grain-oriented electrical steel strip is passed through the line with a lead strip (which will not constitute a portion of the finished product) connected to the leading end of the strip to be processed. When the lead strip has been passed over the entire length of the line, the line is stopped and the temperature of the baking furnace in the insulation coating unit is lowered. Then, the strip is cut on the entry side of the groove-scribing unit. Next, the leading end of the downstream strip is passed over the bridle roll and connected to the tail end of the upstream strip, thus forming a detour pass line. Then, the temperature of the baking furnace is raised to the desired level and the line is started again.

But this method has the following shortcomings.

(1) Stopping the line significantly lowers productivity (tonnage output per hour).

(2) Lowering and raising the baking furnace temperature entails additional energy cost.

(3) Cutting and connecting the strip is an elaborate job requiring additional manpower.

(4) The use of the lead strip pushes up the operation cost.

SUMMARY OF THE INVENTION

The object of this invention is to provide an apparatus for processing grain-oriented electrical steel strip that can provide pass lines foe two processes with and without a core-loss improving step without taking the trouble of stopping the processing line and cutting and connecting the strip halfway.

In an apparatus for processing grain-oriented electrical steel strip according to this invention which comprises a groove-scribing unit, which, in turn, comprises a groove-scribing roll and a pressing roll disposed thereunder, placed on the entry side of an insulation coating unit, with a bridle roll provided above the groove-scribing roll so that the strip is passed thereover when the strip is to be passed through both of the groove-scribing and insulation coating units, a roll guide is provided to allow the bridle roll to move from above the groove-scribing roll to below the horizontal pass line of the strip and vice versa and a moving device is attached to the birdle roll so that the bridle roll is moved up and down along the roll guide together with the strip passed thereover. When the bridle roll is positioned above the groove-scribing roll, the groove-scribing roll and the pressing roll are kept close to each other to form linear grooves in the surface of the strip which is then delivered to the insulation coating unit. When the bridle roll is positioned below the pass line of the strip, the groove-scribing roll and the pressing roll are opened, thereby allowing the strip to travel to the insulation coating unit without touching the two rolls in the groove-scribing unit.

Comprising a conventional insulation coating line and a core-loss improving unit, the grain-oriented electrical steel strip processing apparatus according to this invention permits easy switching between an ordinary insulation coating process and a dual-purpose process in which insulating coating and core-loss improving processes are implemented without stopping the line and cutting the strip, thereby greatly facilitating the application of the core-loss improving process.

DESCRIPTION OF THE PREFERRED EMBODIMENTS

Figure 1:
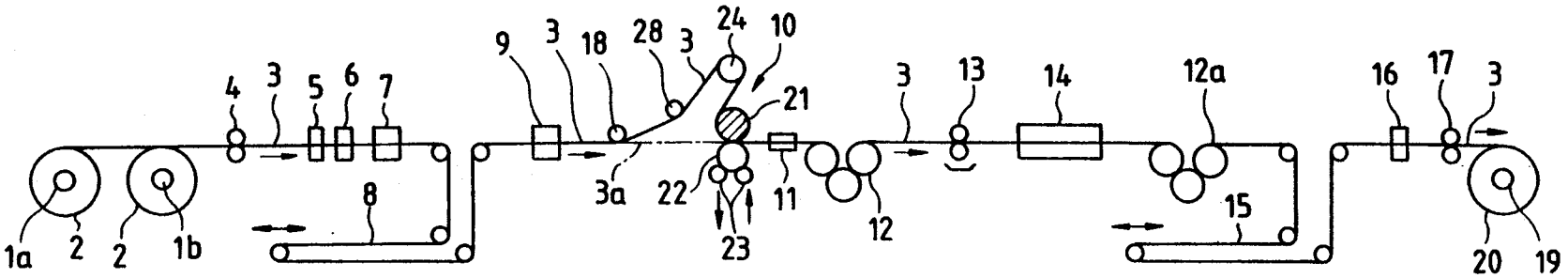
FIG. 1 is an overall view of an apparatus for processing grain-oriented electrical steel strip according to this invention.
Figure 2:
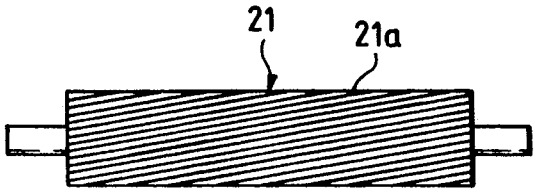
FIG. 2 is a front view showing an example of a groove-scribing roll.

In an apparatus for processing grain-oriented electrical steel strip shown in FIG. 1, as-annealed strip 3 unwrapped from coils 2 on payoff reels 1*a*, 1*b* travels to a shear 5 via pinch rolls 4, then to a welder 6, a flushing unit 7, a looper 8, and a pickling unit 9 where excess magnesium oxide is removed. Then, a toothed roll 21 in a groove-scribing unit 10 scribes grooves in the surface of the strip, with the resulting metal powder removed by a cleaner-drier 11. As shown in FIG. 2, the toothed roll 21 has helical grooves 21*a* cut around the roll axis. By way of bridle rolls 12, the strip 3 travels forward to a roll coating unit 13, where an insulation coating liquid is applied, and further to a baking furnace 14 consisting of a preheating, a heating and a cooling zone (not shown) where the strip is heat-treated at a temperature of 750° C. or above and the insulation coating formed thereon is baked. The strip 3 then travels to a take-up reel 19, via bridle rolls 12*a*, a looper 15, a shear 16 and pinch rolls 17, where it is wound into a product coil 20.

Figure 3:
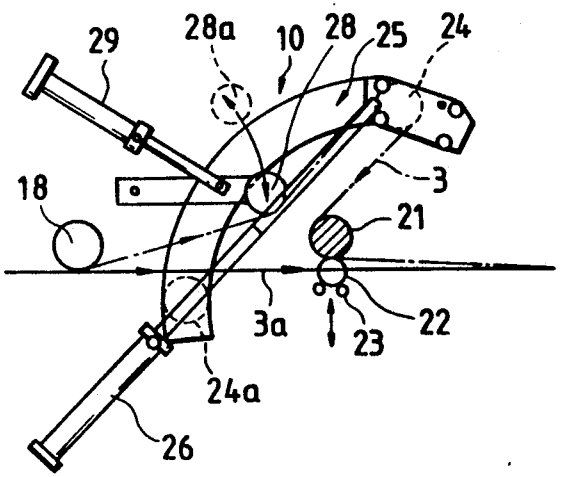
FIG. 3 is a schematic side elevation of a groove scribing unit.

As schematically enlarged in FIG. 3, the groove-scribing unit 10 comprises the stationary toothed roll 21 positioned above the horizontal pass line of the strip and a pressing roll 22 provided therebelow. Two back-up rolls 23 contained in a bracket 23 are placed below the pressing roll 22 to provide support thereto. "Referring to FIG. 4" bracket 23*a* is guided by bracket guides 23*b* at both ends thereof and connected to a hydraulic cylinder 23*c*. The hydraulic cylinder 23*c* moves up and down the bracket 23*a*, whereby the pressure the pressing roll 22 exerts on the strip 3 is adjusted. As is schematically illustrated in FIG. 3, the bridle roll 24 above the toothed roll 21 is movably supported by an arched travel guide 25. Actuated by a hydraulic cylinder 26, the bridle roll 24, with the strip 3 passed thereover, moves between a point 24 above the toothed roll 21 and a point 24*a* below the horizontal pass line. As shown in FIGS. 1 and 3, a deflector roll 18 to guide the strip 3 is provided on the entry side of the groove-scribing unit 10. A control roll 28 is provided between the deflector roll 18 and the bridle roll 24. The control roll 28 applies a pressure on the strip 3 between the deflector roll 18 and the bridle roll 24, and adjusts the access angle of the strip 3 to the bridle roll 24 by controlling the applied pressure.

The configuration of a preferred embodiment of this invention is as described above. FIG. 3 shows a condition in which longitudinal grooves are scribed in the surface of the strip 3 covered with a glass film. The strip 3 supplied to the groove-scribing unit 10 is passed over the bridle roll 24 disposed above the toothed roll 21, with the control roll 28 applying a pressure thereon so that the strip 3 maintains the desired access angle with respect to the bridle roll 24. When the access angle of the strip 3 to the bridle roll 24 is large enough, for example 180 degrees or above, the unwanted breadthwise movement of the strip 3 can be effectively prevented, thereby assuring a stable strip travel. After groove scribing, the roll coating unit 13 applies an insulation coating liquid on the strip 3 as shown in FIG. 1. Then, an insulation coating is formed in the baking furnace 14 in which the core-loss improving heat-treatment at a temperature of 750° C. or above is also applied.

When a need arises to switch from an operation involving the core-loss improving process to a simpler operation of only forming an insulation coating on the surface of ordinary grain-oriented electrical steel strip, the pressing roll 22 and back-up rolls 23 shown in FIG. 3 are lowered, the control roll 28 is retracted to an upper position 28*a*, and the hydraulic cylinder 26 move the bridle roll 24 along the arched travel guide 25 to a position 24*a* below the horizontal pass line, together with the strip 3 passed thereover.

This provides a new horizontal pass line between the toothed roll 21 and the pressing roll 22, with ample clearance left therebetween. Through this horizontal pass line, the strip 3 is led to the roll coating unit 13, without getting scribed by the toothed roll 21 and unnecessarily wearing off the scribing teeth provided thereon, where the formation of an insulation coating on ordinary grain-oriented electrical steel strip is accomplished.

When a need arises to switch from the simpler operation just described to an operation involving the core-loss improving process, the bridle roll 24 is moved from the lower position 24a below the horizontal pass line to above the toothed roll 21, together with the strip 3 passed thereover, by reversing the steps described above.

Now details of the arched travel guide 25 for the groove-scribing unit 10 and the moving mechanism of the bridle roll 24 will be described by reference to FIGS. 4 and 5.

Figure 4:
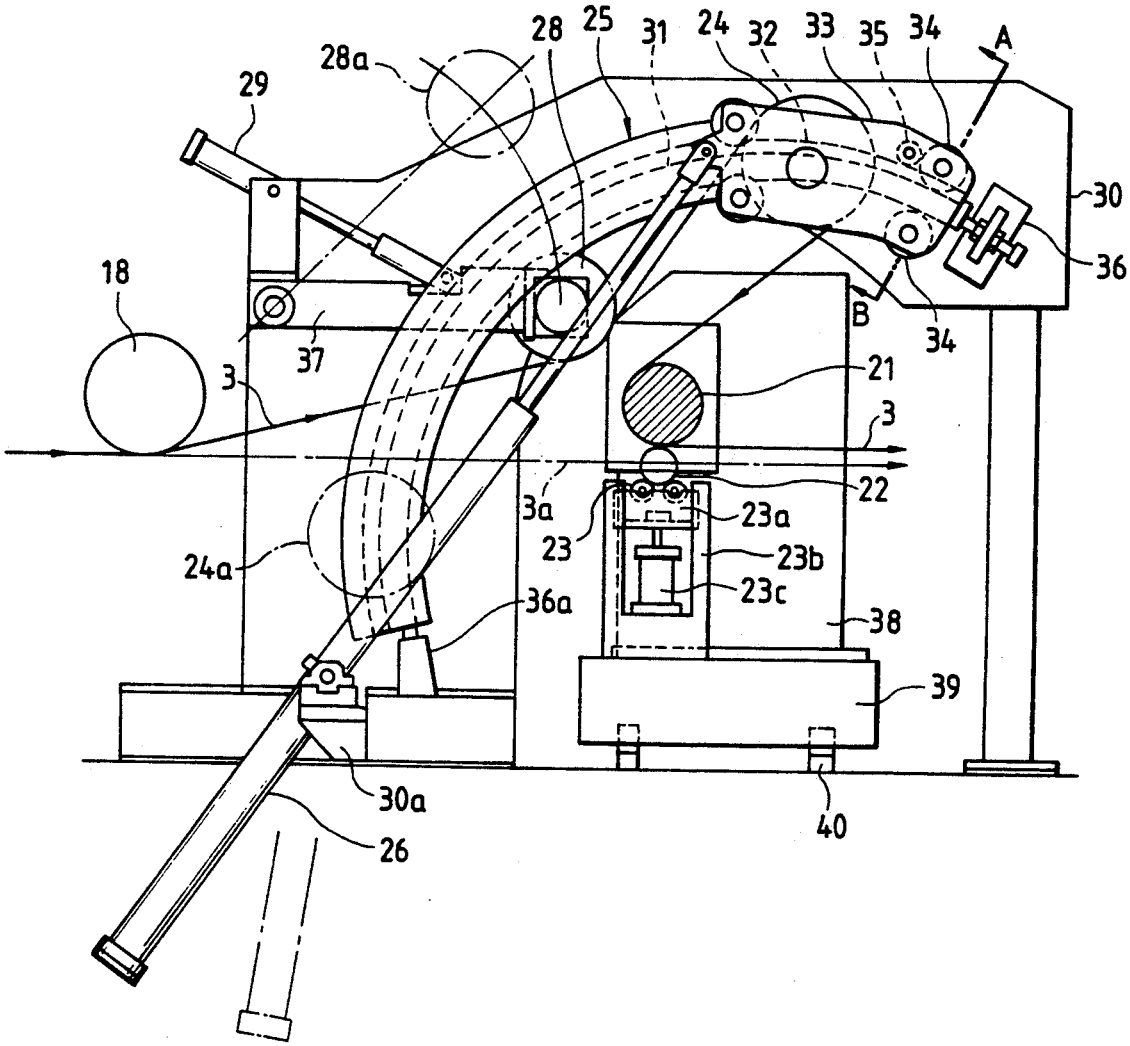
FIG. 4 is a detail side elevation of the groove-scribing unit shown in FIG. 3.
Figure 5:
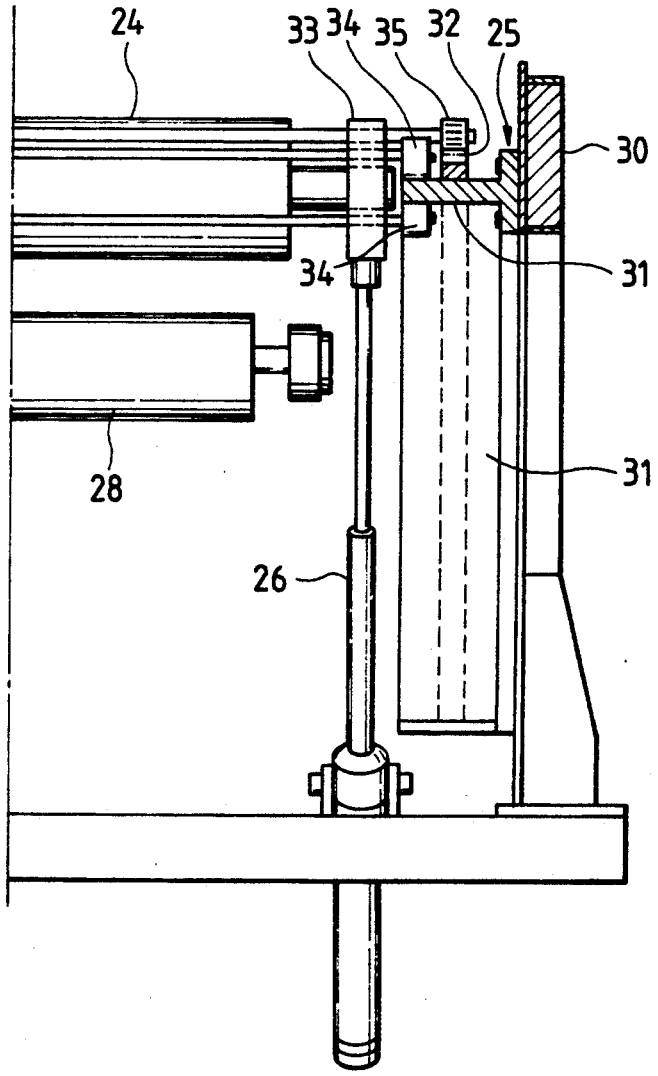
FIG. 5 is a cross-sectional view taken along the line A–B of FIG. 4.

FIG. 4 is a side elevation similar to FIG. 3, and FIG. 5 shows a cross-sectional view taken along the line A–B of FIG. 4. FIGS. 4 and 5 show only those of the devices on one side of the bridle roll 24 which are actually provided on both sides thereof.

The arched travel guide 25 contained in a frame 30 carries an arched guide rail 31 and an arched rack 32 inside. Two sets of paired guide rolls 34 supported by a bearing assembly 33 are provided above and below the arched guide rail 31, whereas the arched rack 32 meshes with a pinion 35 supported by the bearing assembly 33. The neck of the bridle roll 24 is supported by the bearing assembly 33 which is connected to the hydraulic cylinder 26 (of a three-piece telescope type). The hydraulic cylinder 26 is swingably attached to a bracket 30a disposed in the lower rear portion of the frame 30. Stoppers 36 and 36a are attached to the frame 30 at both ends of the arched travel guide 25. On contacting the stoppers 36 and 36a, the bearing assembly 33 comes to a stop. Provided at the free end of a rotating arm 37, the control roll 28 is actuated by a hydraulic cylinder 29 swingably connected to the rear end of the frame 30, thereby applying a pressure on the strip 3 in line or retracting to the off-line position 28. The toothed roll 21, pressing roll 22 and back-up roll 23 are mounted on a stand 38, which is fastened on a carriage 39 adapted to move along rails laid at right angles to the pass line and, therefore, retractable to outside the pass line.

The bridle roll 24 can be lowered from the upper position to the lower position 24a below the pass line by first retracting the control roll 28 to the upper position 28a. When the hydraulic cylinder 26 is actuated to move in the drawing direction, the guide rolls 34 move along the arched guide rail 31, with the pinion 35 meshing with the rack 32 to move the bearing assembly 33 smoothly downward, thereby bringing the bridle roll 24 to the lower position 24a below the horizontal pass line.

What is claimed is:

1. An apparatus for processing grain-oriented electrical steel strip comprising a unit for passing the strip along a horizontal pass line, a groove-scribing unit for cutting longitudinal grooves in the surface of the strip by means of a groove-scribing roll mounted on a pressing roll with means to adjust the roll gap therebetween, the two rolls holding the strip therebetween, and a unit for forming an insulation coating on the surface of the strip provided on the exit side of the groove-scribing unit said groove-scribing unit comprising:

means for guiding the travel of a bridle roll extending from above the groove-scribing roll to below the pass line of the strip;

means for holding a bridle roll adapted to move along the bridle roll guiding means;

a bridle roll rotatably attached to the bridle roll holding means; and means for moving the bridle roll holding means along the bridle roll guiding means with the strip passed around the bridle roll;

whereby the strip can be selectively passed to the insulation coating forming unit either after scribing longitudinal grooves in the surface thereof by means of the groove-scribing and pressing rolls by holding said rolls close to each other and holding the strip therebetween which is supplied thereto by way of the bridle roll positioned above the groove-scribing roll, or without scribing longitudinal grooves in the surface of the strip by allowing it to travel forward without contacting the groove-scribing and pressing rolls by keeping said rolls away from each other with the bridle roll positioned below the pass line.

2. An apparatus for processing grain-oriented electrical steel strip according to claim 1, in which the groove-scribing roll has helical grooves cut around the axis threrof.

3. An apparatus for processing grain-oriented electrical steel strip according to claim 1, in which the bridle roll guiding means arches from above the groove-scribing roll to below the pass line.

4. An apparatus for processing grain-oriented electrical steel strip according to claim 1, in which the bridle roll guiding means comprises a guide rail.

5. An apparatus for processing grain-oriented electrical steel strip according to claim 1, in which the bridle roll guiding means comprises a rack arching from above the groove-scribing roll to below the pass line and a pinion that is attached to the bridle roll holding means and meshes with the rack.

6. An apparatus for processing grain-oriented electrical steel strip according to claim 1, in which the bridle roll holding means comprises two sets of paired rolls, one set being provided ahead of the other, that hold the bridle roll guiding means therebetween.

7. An apparatus for processing grain-oriented electrical steel strip according to claim 1, in which the bridle roll moving means comprises a hydraulic cylinder connected to the bridle roll holding means.

8. An apparatus for processing grain-oriented electrical steel strip according to claim 1 which comprises a deflector roll provided on the entry side of the bridle roll guiding means, a control roll provided between the bridle roll above the groove-scribing roll and the deflector roll which applies pressure on the strip passed between the deflector and bridle rolls, and means for reciprocating the control roll either by pushing out the control roll by a controlled amount to adjust the access angle of the strip with respect to the bridle roll or by retracting the control roll away from the pass line.

9. An apparatus for processing grain-oriented electrical steel strip according to claim 1, in which the groove-scribing and pressing rolls are mounted on a carriage that is movable at right angles with the pass line.

* * * * *

UNITED STATES PATENT AND TRADEMARK OFFICE

CERTIFICATE OF CORRECTION

PATENT NO. : 5,085,411

DATED : February 4, 1992

INVENTOR(S) : Yoshinao TANAKA, et al.

It is certified that error appears in the above-identified patent and that said Letters Patent is hereby corrected as shown below:

Column 3, line 5, change "foe" to --for--.

Column 3, line 21, change "birdle" to --bridle--.

Column 4, line 14, delete the quotation marks before "Referring".

Column 4, line 15, delete the quotation marks after "FIG. 4" and insert --,--.

Column 4, line 58, change "move" to --moves--.

Column 5, line 65, insert a comma after "unit".

Signed and Sealed this

Twentieth Day of July, 1993

*Attest:*

*Attesting Officer*

Michael K. Kirk

MICHAEL K. KIRK

*Acting Commissioner of Patents and Trademarks*